US005510571A

United States Patent [19]

Huang et al.

[11] Patent Number: 5,510,571

[45] Date of Patent: Apr. 23, 1996

[54] DRIVING MECHANISM FOR A MUSIC BOX MOUNTED DOLL

[76] Inventors: Ching-Fa Huang, 5th Fl., No.7-1, Alley 56, Lane 166, Shin Pai Rd. Sec.1; Feng-Hsiang Hsu, 7th Fl., No.9, Lane 100, Ho Chiang Street, both of Taipei, Taiwan

[21] Appl. No.: 366,108

[22] Filed: Dec. 29, 1994

[51] Int. Cl.[6] ..... G10F 1/06; A63H 3/28; G09F 27/00

[52] U.S. Cl. ..... 84/95.2; 446/298; 40/455

[58] Field of Search ..... 84/95.2, 95.1, 84/94.2, 94.1; 446/298, 300, 301; 40/455, 457, 416, 418, 419, 420

[56] References Cited

U.S. PATENT DOCUMENTS 5,161,420 11/1992 Feng ..... 84/95.2

5,371,318 12/1994 Hsu et al. ..... 84/95.2

*Primary Examiner*—Cassandra C. Spyrou

*Attorney, Agent, or Firm*—Bacon & Thomas

[57] ABSTRACT

An improved doll driving mechanism for use in a music box is equipped with an eccentric shaft having a linkage arm engaged with the output shaft of a music playing unit of the music box. The eccentric shaft provided with at least a journalled section is in driving engagement with an open-ended slot of a main linkage plate having an extended driving rod at one end. Three secondary linkage plates are engaged with each other or with the main linkage plate respectively and the linkage plates are associated with pivotal arms, legs and head and an openable chin of a doll mounted onto the music box by rigid wires so that those moving parts of the doll or an article of the like can be pivotally actuated in synchronism with played music.

3 Claims, 6 Drawing Sheets

DRIVING MECHANISM FOR A MUSIC BOX MOUNTED DOLL

BACKGROUND OF THE INVENTION

The present invention relates to an improved doll driving mechanism for a music box. A doll having a pivotal hat and an openable chin and arms and legs is connected to corresponding parts of a driving mechanism of the present invention by rigid wires whereby the pivotal parts of the doll or an article of the like can perform in synchronism or tune with played music various motions as designed.

Generally, music boxes have been popularly reserved by people as souvenirs because of their fascinating artistic structures and elegant music songs mechanically recorded in the boxes thereof. Most of those prior art music boxes are equipped with dolls, animals or articles of the like, but such articles can be rotated only with played musics. It is boring to see a doll mounted onto a box to perform repeated simple motions for a long time.

SUMMARY OF THE INVENTION

The primary object of the present invention is to provide a doll driving mechanism housed in a music box which is connected by rigid wires to pivotal arms, legs and. a hat and an openable chin of a doll so that those parts of the doll can be moved in synchronism with music played by a music box.

Another object of the present invention is to provide a doll driving mechanism which is provided with a main linkage plate engaged with an eccentric shaft by a linking arm connected to the driving shaft of a music playing unit of a music box. The main linkage plate has a 45-degree slot so that the range of corresponding motions of the parts of a doll can be effectively increased.

One further object of the present invention is to provide a doll driving mechanism which is simple to assemble and easy to dismount and the number of secondary linkage plates can be varied according to the number of movable parts of a doll.

One still further object of the present invention is to provide a doll driving mechanism which has a main linkage plate and a number of secondary linkage plates that are provided with wire securing lugs the number of which can be varied according to practical requirements.

BRIEF DESCRIPTION OF THE INVENTION

DETAILED DESCRIPTION OF THE INVENTION

Figure 1:
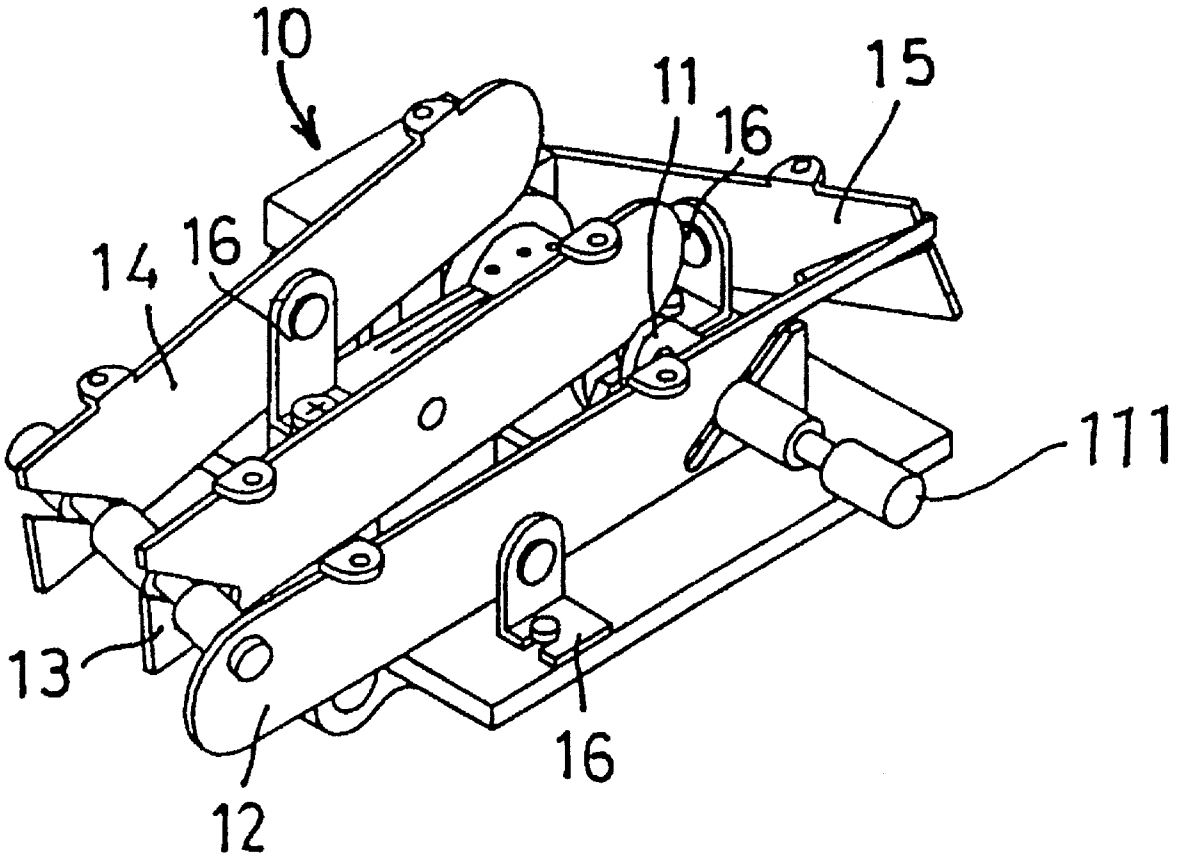
FIG. 1 is a perspective diagram showing the assembled doll driving mechanism of the present invention.
Figure 2:
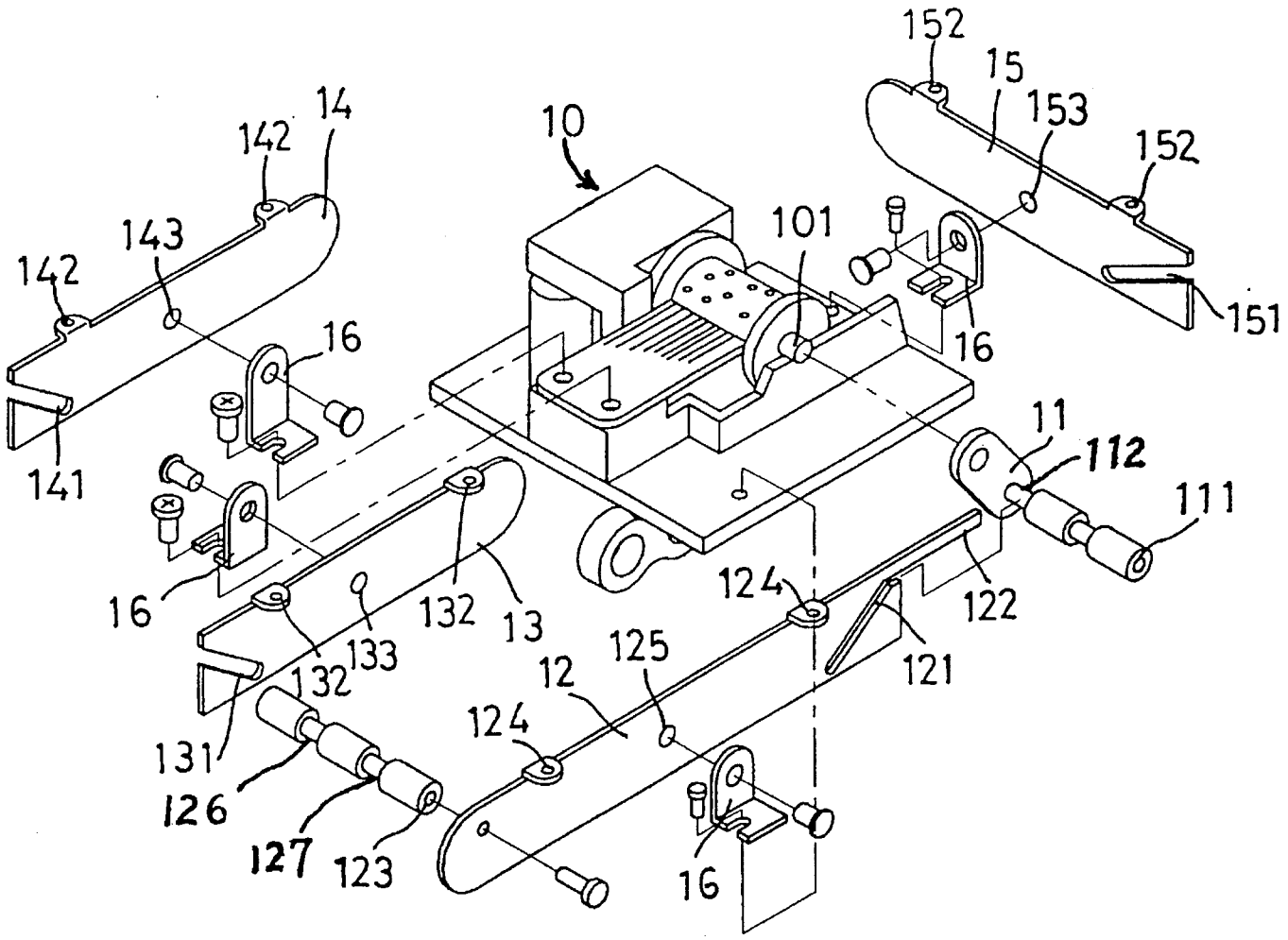
FIG. 2 is a perspective diagram showing the exploded components of the present invention.

Referring to FIGS. 1, 2, the doll driving mechanism associated with a music box is mainly comprised of a music playing unit 10, a linking arm 11 engaged with an eccentric shaft 111 at one end thereof, a main linkage plate 12 and three secondary linkage plates 13, 14, each being secured in place and assembled by a fixing unit 16 and fixing holes 133, 143 and 153.

The music playing unit 10 serves to supply mechanical power to a motionable doll of the present invention. The driving shaft 101 of the music playing unit 10 is engaged with one end of the linking arm 11 which is then in driving relation with the eccentric shaft 111 at the opposite end thereof so that the rotation of the drying shaft 101 causes the eccentric shaft 111 to move in a circular path.

The main linkage plate 12 has an extended rod 122 at the right end thereof and a 45-degree engagement slot 121 pointing upwardly to the extended pole 122. The journal end 112 of the eccentric shaft 111 is engaged with the engagement slot 121. The main linkage plate 12 having a fixing hole 125 at the center thereof is pivotally mounted to the music playing unit 10 by a fixing unit 16 so that it can be actuated by the eccentric shaft 111 to act like a see-saw.

A pair of secondary linkage plates 13, 14 are secured to the music playing unit 10 in parallel to each other and also to the main linkage plate 12. A driving shaft 123 having two journalled sections 126, 127 is fixed to the left end of the main linkage plate 12. Each of the secondary linkage plates 13 and 14 has a slanted slot 131 or 141 which points to the upper left corner thereof.

Figure 3A:
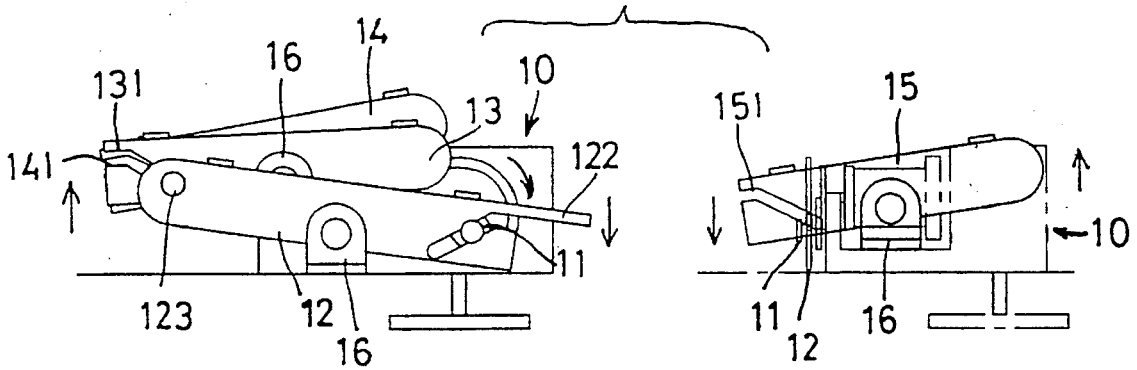
FIG. 3A is a combination diagram showing the operation mode and the relation of the secondary linkage plates of the present invention.
Figure 3B:
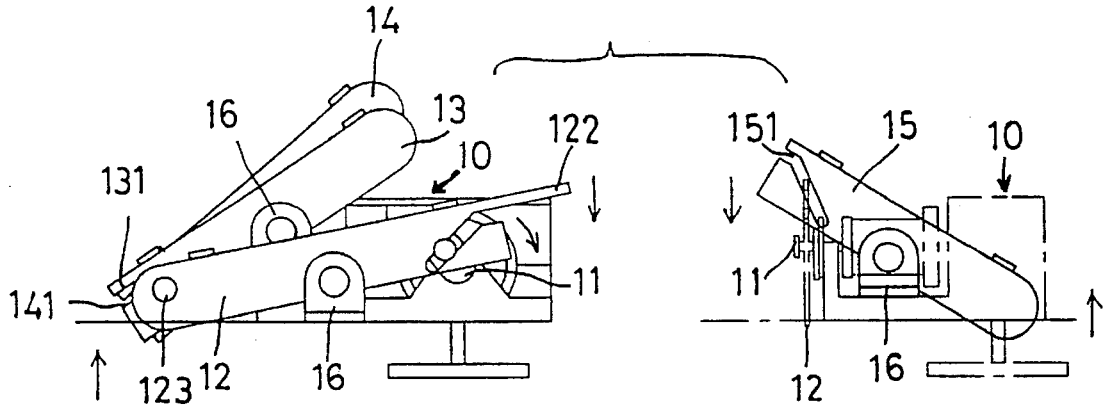
FIG. 3B is a combination diagram showing another operation mode and the relation of the secondary linkage plates thereof.
Figure 3C:
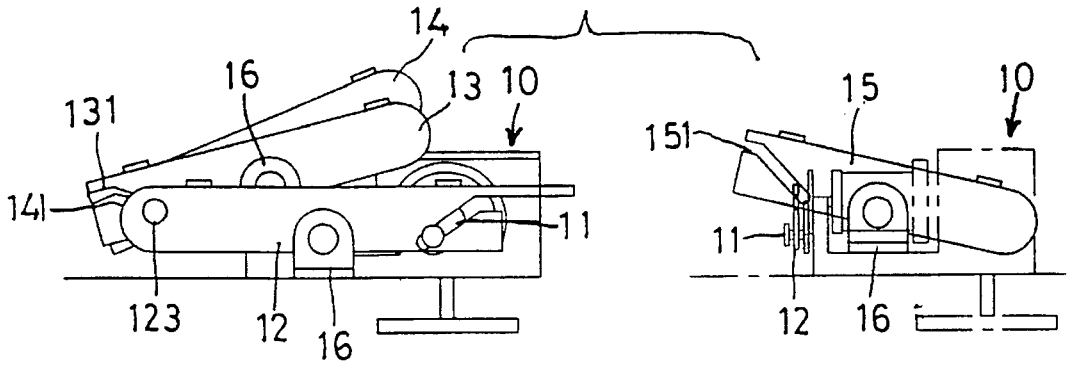
FIG. 3C is one further combination diagram showing the operation mode and the relation of the secondary linkage plates thereof.

The driving shaft 123 is associated with the secondary linkage plates 13, 14 respectively by engagement of the journalled sections 126, 127 with the slots 131 and 141 so that the movement of the main linkage plate causes the pivotal motion of the secondary linkage plates, as shown in FIGS. 3A, 3B, 3C.

A third secondary linkage plate 15 is also pivotally fixed by a fixing unit 16 to the music playing unit 10 in such a manner that it is orthogonally disposed with respect to the parallelly fixed secondary linkage plates 13, 14. The slot 151 of the secondary linkage plate 15 is engaged with the extended rod 122 of the main linkage plate 12 so that the see-saw motion of the main linkage plate 12 can also cause pivotal motion of the secondary linkage plate 15 fixed at the center thereof to the music playing unit 10.

The main linkage plate 12 having a pair of wire securing lugs 124 the number of which can be varied according to practical requirements. Similarly, all the secondary linkage plates 13, 14, 15 have identical wire securing lugs 132, 142 and 152 respectively.

Figure 4:
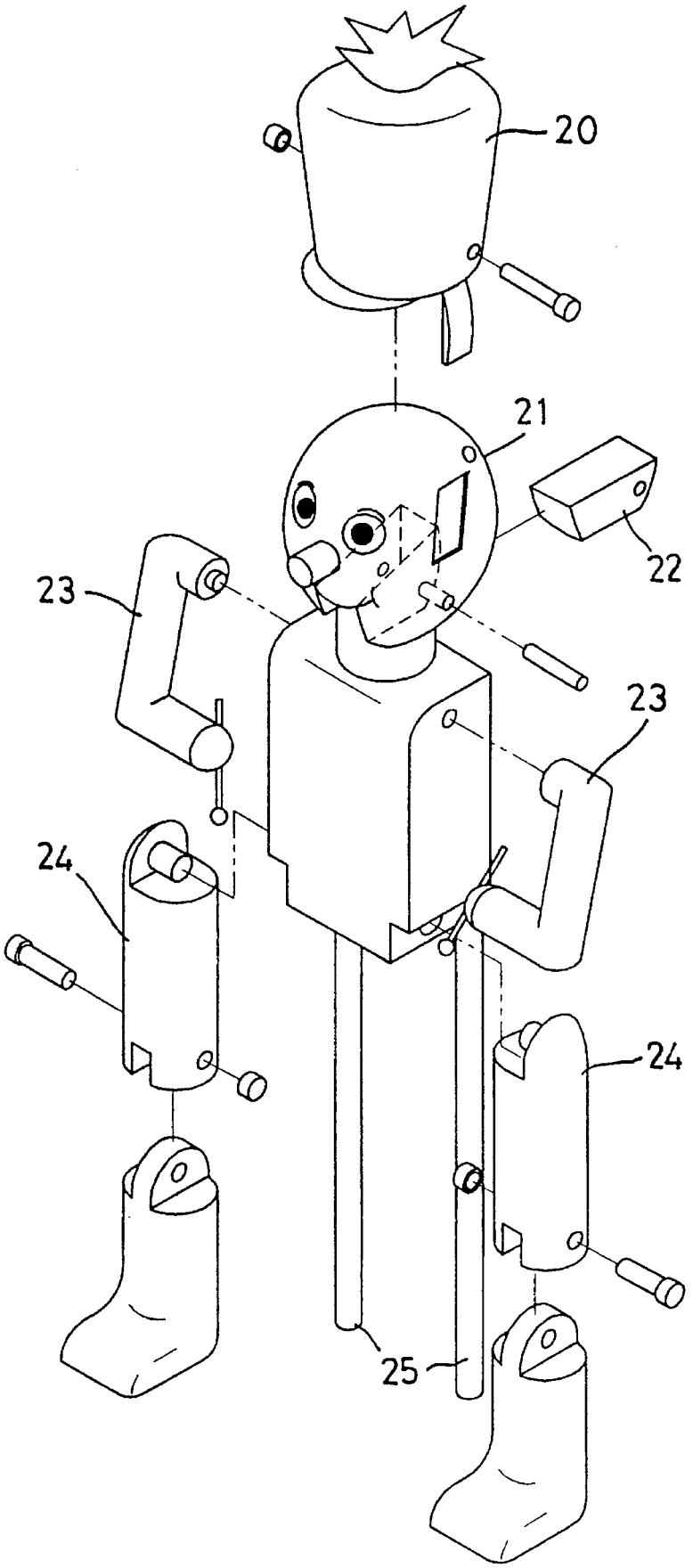
FIG. 4 is a perspective diagram showing the corresponding components of a motionable doll of the present invention.

Referring to FIG. 4, exploded components of a doll having pivotally actuated arms 23, legs 24 and head 21 with an openable chin 22 and a movable hat 20 are shown. The doll is equipped with a pair of vertical poles 25 at the bottom thereof which are fixed in place to a case 35 in which the doll driving mechanism of the present invention is housed. There are several through holes 36 disposed on the case 35 so as to permit rigid wires 30 to be led therethrough.

Figure 5A:
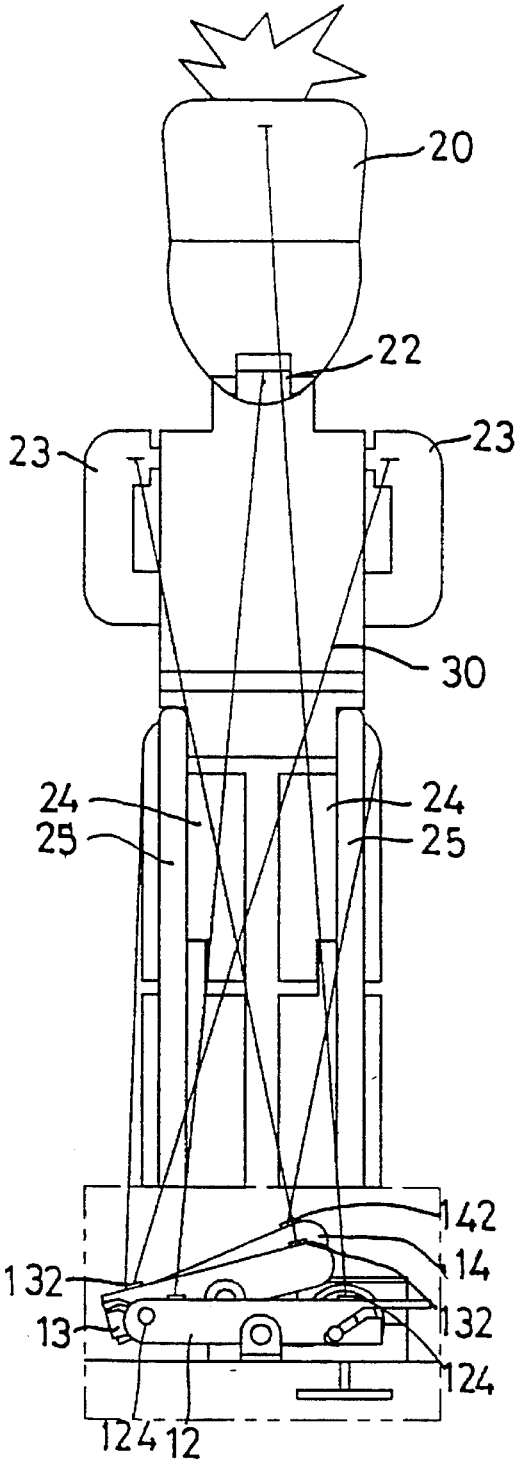
FIG. 5A is a rear view showing the wiring connection of the doll driving mechanism of the present invention to movable parts of a doll.
Figure 5B:
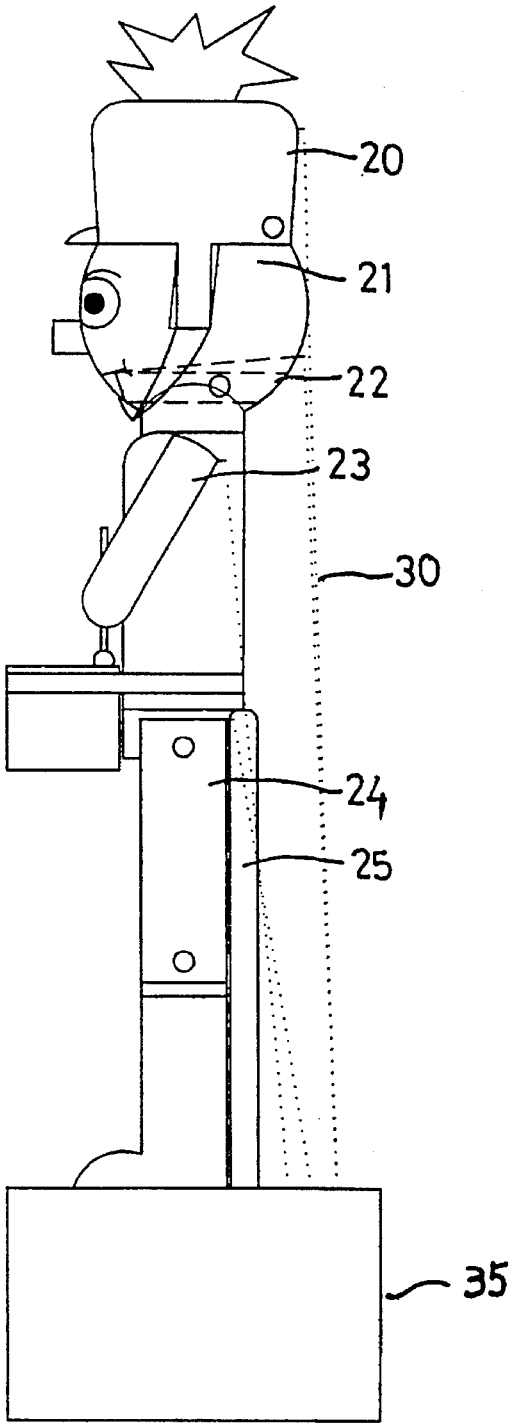
FIG. 5B is a side view showing the wiring connection of the doll driving mechanism thereof.

Referring to FIGS. 5A, 5B, the arms 23 of the doll are engaged with the wire securing lugs 132 of the secondary linkage plate 13 by rigid wires 30 in a cross manner. The legs 24 are associated with the wire securing lugs 142 of the secondary linkage plate 14 also by a pair of crossly disposed rigid wires 30. The hat 20 and the chin block 22 are engaged with the wire securing lugs 124 of the main linkage plate 12 by rigid wires 30.

Figure 6B:
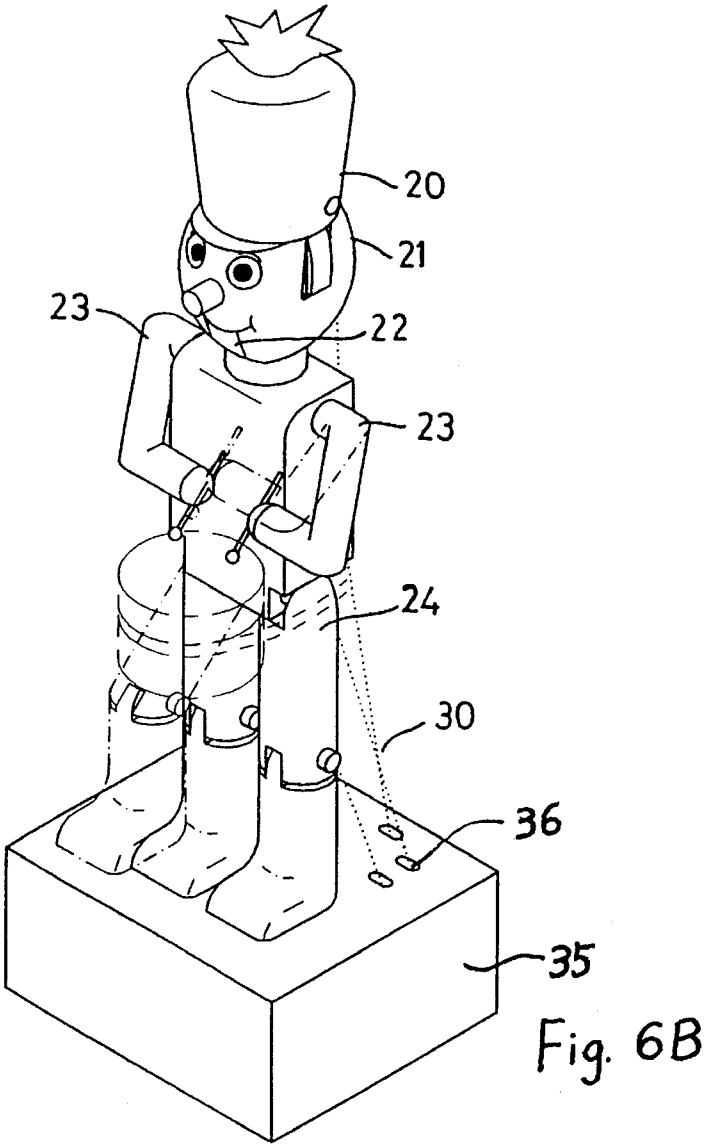
FIG. 6B is a diagram showing another operation mode of the doll shown in FIG. 6A.
Figure 6A:
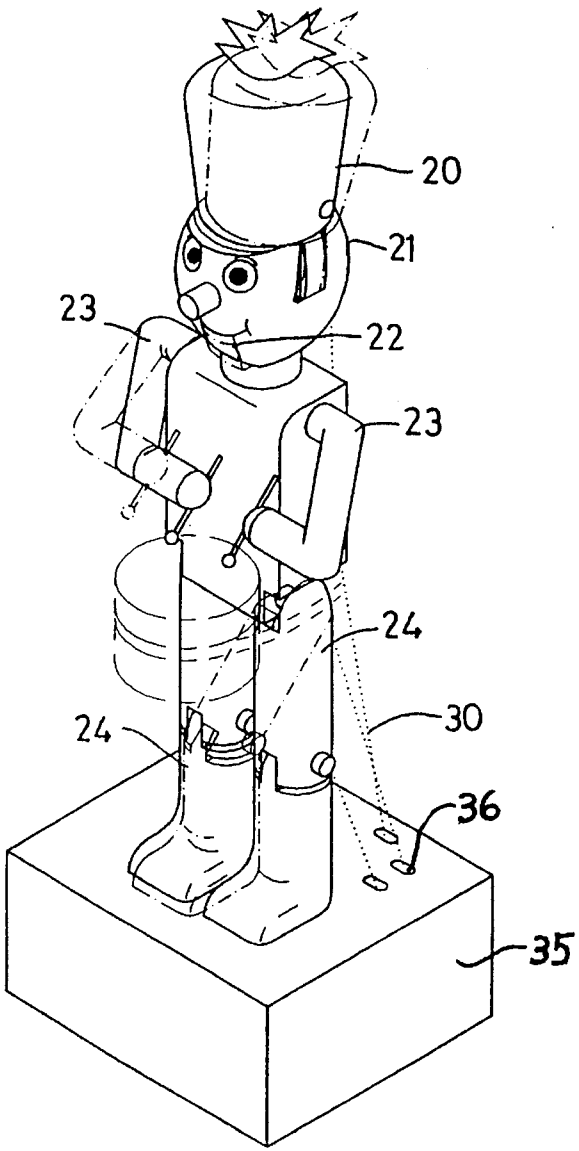
FIG. 6A is a diagram showing the operation mode of a doll actuated by the driving mechanism of the present invention.

Referring to FIGS. 6A, 6B, the arms 23, legs 24 and the hat 20 and the chin block 22 are engaged with the main linkage plate 12 and the secondary linkage plates 13, 14 in such a manner as described above that once the driving shaft 101 of the music generating unit 10 spring powered is actuated to rotate, the arms, 23, legs 24 and the hat 20 and chin block 22 are pivotally moved in tune with played music.

We claim:

1. An improved doll driving mechanism for use with a music box having a music playing unit with a spring powered rotating driving shaft, comprising:

a linking arm engaged with said rotating driving shaft of said music playing unit of said music box so as to rotate therewith;

an eccentric shaft disposed on said linking arm and having a journalled section;

a main linkage plate pivotally mounted on said music playing unit and having at least a pair of wire securing lugs, an open-ended slot and an extended rod at a first end thereof; said journalled section of said eccentric shaft being engaged with said open-ended slot of said main linkage plate;

at least a pair of secondary linkage plates pivotally mounted on said music playing unit and being parallelly disposed with respect to said main linkage plate; each of said secondary linkage plates having an open-ended slot at one end thereof and at least a pair of wire securing lugs;

a driving shaft having two journalled sections secured to a second end, opposite to the first end having the open-ended slot, of said main linkage plate such that the slot of one of the second linkage plates is engaged with one of said journalled sections of said driving shaft;

a doll having a plurality of pivotal parts;

a plurality of rigid wires each having one end connected to one of said wire securing lugs of said secondary linkage plates or said wire securing lugs of said main linkage plate, the other end of each of said rigid wires connected to one of the pivotal parts of said doll whereby said pivotal parts of said doll are moved in synchronism with said driving shaft of said music playing unit.

2. The improved doll driving mechanism as claimed in claim 1 further comprising at least one additional secondary linkage plate pivotally mounted on said music playing unit orthogonally with respect to said main linkage plate said additional secondary linkage plate having a slot located such that said extended rod of said main linkage plate engages said slot of the orthogonally disposed additional secondary linkage plate.

3. The improved doll driving mechanism as claimed in claim 1 wherein said open-ended slots of at least one of said main linkage plate and said secondary linkage plates is slantly disposed with respect to a horizontal line at an angle of 45 degrees so as to permit said pivotal parts of said doll to move in a maximum range.

* * * * *